United States Patent [19]

Bogner et al.

[11] 4,119,970

[45] Oct. 10, 1978

[54] DIPOLE-SLOT TYPE OMNIDIRECTIONAL TRANSMITTING ANTENNA

[76] Inventors: Richard D. Bogner, 4 Hunters La., Roslyn, N.Y. 11576; Leonard H. King, 67 Southgate Rd., Valley Stream, N.Y. 11581

[21] Appl. No.: 843,586

[22] Filed: Oct. 19, 1977

[51] Int. Cl.[2] ..... H01Q 21/00; H01Q 13/10; H01Q 9/16

[52] U.S. Cl. ..... 343/727; 343/806; 343/821; 343/770

[58] Field of Search ..... 343/726, 727, 730, 744, 343/770, 771, 806, 816, 821

[56] References Cited

U.S. PATENT DOCUMENTS

| | | | |
|---|---|---|---|
| 2,465,245 | 3/1949 | Mabry | 343/821 |
| 2,512,137 | 6/1950 | Buchwalter | 343/892 |
| 3,474,452 | 10/1969 | Bogner | 343/813 |
| 4,031,536 | 6/1977 | Alford | 343/806 |
| 4,054,877 | 10/1977 | Bogner et al. | 343/821 |

*Primary Examiner*—Alfred E. Smith
*Assistant Examiner*—Harry E. Barlow
*Attorney, Agent, or Firm*—Leonard H. King

[57] ABSTRACT

An omnidirectional broad band antenna employs a slot and a pair of radiating arms excited by the slot. In one embodiment slots are formed in a coaxial transmission line and covered by a resin bonded filament wound glass fiber tube which serves as an integral radome and permits pressurization. The arms are of substantial girth and arc upwardly, downwardly respectively and circularly, one clockwise and the other counterclockwise thus providing a large spacing between arms. The antenna is characterized by a broad bandwidth and low VSWR.

3 Claims, 3 Drawing Figures

DIPOLE-SLOT TYPE OMNIDIRECTIONAL TRANSMITTING ANTENNA

BACKGROUND OF THE INVENTION

Omnidirectional circularly polarized broadcast antennas for stations operating in the FM band are often of the type described in previous U.S. Pat. No. 3,474,452 of Richard D. Bogner, one of the applicants herein. That is, each bay consists of thin arms (less than 1/20 wavelength in girth for at least a substantial part of their length) extending away from a vertical coaxial transmission line, and are excited from the line by one (or more) thin metal straps connected between the line center conductor and one arm. These designs have the characteristics of being narrow band i.e. the impedance varies rapidly with frequency such that the VSWR is often under 1.1 over only 50 to 100 KHz, whereas the station transmits a 200 KHz band. The antennas are critical with regard to the region of the strap and the small opening in the vertical coaxial line, such that dirt, ice, humidity, very small mechanical movements tend to detune the antenna. This prior art construction frequently requires the use of fine tuners, radomes, deicers and frequently require repair or readjustment. The excitation straps and the narrow spacing also makes possible voltage breakdown in that area of the antenna.

It has been found that these undesirable characteristics can be eliminated, while maintaining or improving the generally desirable radiation pattern and axial ratio characteristics of this antenna type. This is achieved by employing slot excitation and "fat" arms haing a girth of at least 0.1λ or more throughout substantially their entire length of about λ/4 each. Thus there is eliminated the small opening in the coaxial outer conductor and the strap connected through it (to the center conductor on one end, and to a point on one arm on the other end). Arm excitation is achieved by providing a long slot on both sides of the support tube, the slot extending about λ/4 on each side of the feed point, the width of the band having a VSWR under 1.1 can be increased to as much as 1 MHz, the pattern made perfectly symmetrical, and effects of dirt, ice, power, humidity, tolerances and movement made negligible so that no additional radome, deicer, or tuner is needed. It is, in general, desirable for structural reasons due to the thin support tube wall often employed and also to allow line pressurization, to cover the slots with an electrically non-conductive but stong material, such as resin impregnated glass fibers. The arms may be e.g. plates or tubes and, in general, thrust or spiral outwardly and upwardly on one side and out in the same direction and downwardly on the other side of the slot.

In the aforementioned application there is disclosed an antenna comprising a coaxial transmission line provided with a pair of opposed slots in the outer conductor forming a balun to feed a pair of dipoles.

There is a need to enclose the open slot in a pressure tight arrangement to permit of pressurizing the line to prevent the entrance of moisture which would cause failure of the antenna. The construction taught in the said copending application while operative is costly to manufacture and not susceptible to be repaired.

The present invention utilizes a rigid sleeve of filament wound fiberglass secured to bushings bonded to the transmission line. The bushings are provided with a O-ring groove containing an O-ring which seals to the sleeve.

The above description, as well as further objects, features and advantages of the present invention, will be more fully appreciated by reference to the following detailed description of a presently preferred, but nontheless illustrative embodiment in accordance with the present invention when taken in conjunction with the accompanying drawings wherein:

IN THE DRAWING

DESCRIPTION OF THE PREFERRED EMBODIMENT

The antenna of this invention has been found particularly suitable for the FM broadcast band. At the present time in the United States this band extends from 88 to 108 megahertz. Each station is assigned a channel having a bandwidth of 200 kilohertz and the term lamda (λ) refers to a frequency at the center of the assigned channel. It is important that an antenna maintain a voltage standing wave ratio (VSWR) over the 200 KHz operating band within assigned channel of less than 1.1.

The present invention makes use of the standard transmission line commonly used in the broadcast industry. Such lines are most commonly available in standard sizes having an outside diameter of 1 $\frac{5}{8}$, 3 $\frac{1}{8}$ and 6 $\frac{1}{8}$ inches. The standard lines are provided with an impedance characteristic of 50 ohms.

Figure 1:
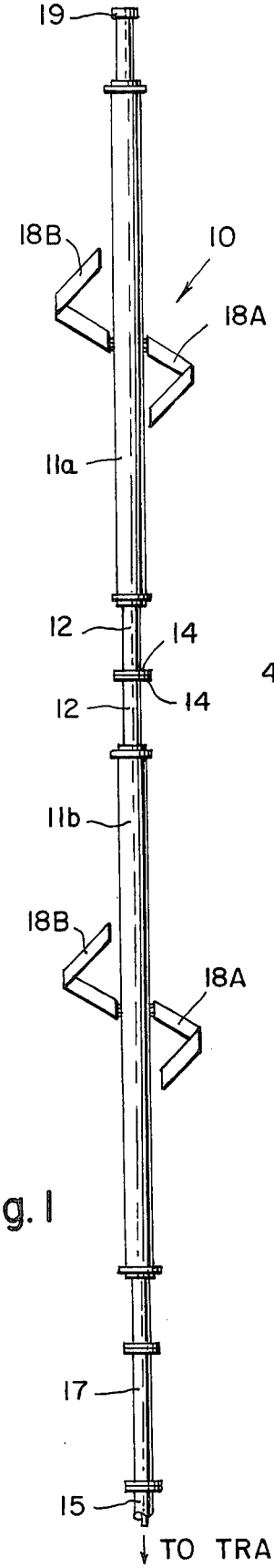
FIG. 1 is a front elevational view of a two bay antenna of this invention.
Figure 2:
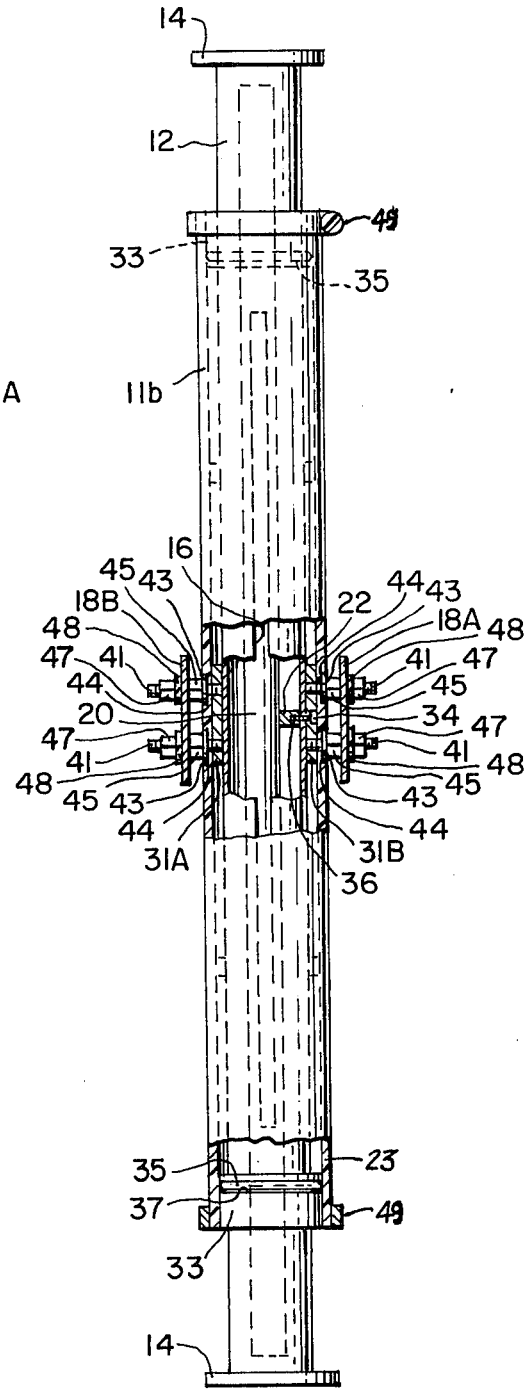
FIG. 2 is a partially broken away front elevational view of a single intermediate antenna bay.

Referring now to FIG. 1 wherein there is shown a typical multiple bay antenna of this invention, indicated generally by the numeral 10. As will be discussed more fully hereinafter each bay includes a section of transmission line 12 which is coupled to a succeeding bay by conventional flanges 14. Two bays 11*a* and 11*b* are representative of multiple bay antennas which generally consist of one to 12 bays. The individual bays have a characteristic impedance of 50 ohms, assuming 50 ohm line is employed, and therefore present an impedance of 100 ohms to the transmission line 15. This requires the use of a 2:1 transformer section 17. If five bays were employed then a 5:1 transformer would be used. The upper bay 11*a* terminates in a sealed cap member 19. The transmission line 12 is generally a hard copper tube with a smaller diameter copper tube as the centrally located inner conductor. The transmission line is terminated at its end with a standard flange member 14 for connection to additional bays or to a transmission line. Slots 6 as shown in FIG. 2 are formed in the wall of the transmission line, having a length of approximately λ/2. The slots extend through diametrically opposite sides of the transmission line. Near the center points of the walls between the slots there are affixed a pair of arms 18A and 18B that generally spiral about a cylinder of a diameter D. D is approximately the diameter of a circle inscribed and circumscribed by arms having right angle λ/8 portions. The cylinder may be considered as approximately tangent to the vertical section of transmission line 12. The arms are each of a length approximately λ/4. It will be noted that arm 18A spirals downwardly at an angle of between 30° and 60°, while arm 18B spirals upwardly at the same angle.

In order to excite the arms, the center conductor 20 of the coaxial line is connected internally to one wall of the coaxial line by means of a jumper 22. Typically, the slot would be about ½ inch wide for a 1 ⅝ inches line, 1 inch wide for a 3 ⅛ inches line and 1 ½ inches wide for a 6 ⅛ inches line.

It has been found that the girth "C" of the arm has a bearing on the resultant bandwidth. A larger girth producing a wider bandwidth than prior art thin arms and accordingly the girth should be not less than about 0.1λ.

It is, in general, desirable for structural reasons due to the weakening of the coaxial line wall by the slots and in order to allow line pressurization, to cover the slot with an electrically non-conductive sealing material. A construction that satisfies these requirements is shown in FIG. 2.

In order to provide added structural support for the arms, a pair of metal blocks 31A, 31B contoured to the shape of the coaxial tube may be fixed to the walls of the tube by brazing or whatever suitable method which will provide mechanical strength and electrical conductivity. The blocks need only be long enough to support the arms.

Metal block 31B has a hole bored through leading to the interior of the coaxial line. Bolt 34 engages a threaded bore in a jumper 22 attached to the center conductor 20 of the coaxial line. As bolt 34 is tightened into the bore 36, the jumper 22 is drawn up against tube 12 and is secured therein. The bolt may then be solder sealed to the metal block.

The structure is then covered with resin impregnated filament wound fiberglass tube 23, a wall thickness approximately ⅛ to ¼ inch has been found suitable to provide the mechanical strength and sealing to permit pressurization of the line. The resin may be by way of example polyesters or epoxy resins. Such materials are commonly used in the aircraft, boat and reinforced fiberglass industry.

The fiberglass tube seats on bushings 33 which are brazed, soldered or likewise secured to tube 12 and are sealed thereto by O-ring 35 seated in a groove 37. Stainless steel clamps 49 deform the slotted ends of the tube to secure it to the bushing. The slots extend about 1 inch in from the end and are spaced about 1 inch apart. The bushing is about 2 inches long.

Bolts 41 extend through the fiberglass tube into blocks 31A, 31B. Washers 43 are placed on the bolts over a bed of sealant 44, such as silicone rubber, and nuts 45. Nuts 47 and lock washers 48 secure arms 18A, 18B.

Figure 3:
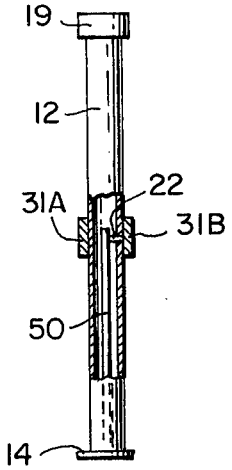
FIG. 3 is a partially broken away front elevational view of an antenna end bay.

In FIG. 3 there is shown an end bay with inner conductor 50 terminated at member 22.

The arms may be flat members as shown or tubes that, in general, thrust and spiral outward and upward on one side and out in the same direction and downward on the other. It has been found convenient to fabricate the arms employing flat plates with right angle bends, however, the arms may be arcuate or otherwise shaped to fit within the above-recited parameters.

Conventional support brackets (not shown) are used to affix the bays to a supporting tower. Such supports are commercially available from a number of sources and form no part of the present invention. If metal, such supports must not make electrical contact between the line and the tower in the region of the slots, but only above and below the slots.

An antenna constructed in accordance with the foregoing was characterized by a horizontal plane pattern which was omnidirectional with ± 1 ½ db for all polarizations and the axial ratio was better than 3 db in any azimuth including the effect of the coaxial feed line. The VSWR was under 1.1 over a band of approximately 1 MHz (corresponding to five (5) FM channels). Surprisingly, a VSWR of under 1.1 was maintained over the design channel without the necessity of employing a fine tuner and even when mounted down to only about 12 inches from the corner of a 120 inches wide triangular tower.

It is preferred to employ a spacing of λ between the dipole feed points, however, other spacings may be employed. For example, by alternating the feed direction from the center conductor to the side wall of successive bays the optimum spacing would be λ/2. If fed by a coaxial line, other spacings may be employed with consideration being given to the effects of spacing on the coupling between bays.

The bays of an array may be fed by the continuous coaxial line as shown in FIG. 1 or may be individually fed by conventional coaxial feed lines from a power divider connected to the transmitter.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a tramsmitting antenna for radiation of signals of wavelength λ consisting of:

(a) a conductive tubular member elongated along a principal axis having a pair of diameterically opposed elongated slots parallel to the said axis defined by a pair of opposed side walls, the slots having an approximate length of λ/2;

(b) a first conductive arm of a length of approximately λ/4 extending arcuately from one of said side walls at approximately the midpoint of the slots, and in electrical connection thereto oriented at an angle of from 30° to 60° to the said axis;

(c) a second conductive arm of a length of approximately λ/4 extending arcuately from the approximate middle of the other of said side walls and in electrical connection thereto at an angle of from 30° to 60° to the said axis; and (d) means for connecting said antenna to a source of signals of wavelength λ for electrically exicting said slots, and in turn exciting said conductive arm, the improvement comprising:

a pair of bushings secured to said tubular members on unslotted portions of said tubular member, the bushings of said pair being axially spaced by said slots;

a circumferential groove in each of said bushings;

an O-ring in each of said circumferential grooves;

a filament wound resin bonded tube surrounding the slot portion of said tubular member and sealed to said bushings by said O-rings;

means mechanically clamping said tube to said bushings; and electrically conductive members extending through said tube and attached to said slot walls securing the conductive arms.

2. The antenna of claim 1 wherein said means mechanically clamping said tube to said bushings comprises deformable finger portions defined by axial slots extending inwardly from the ends of said tube and adjustable metal bands for clamping said finger portions to said bushings.

3. The antenna of claim 1 wherein said electrically conductive members are joined to said tube by a sealant.

* * * * *